US005570515A

United States Patent [19]

Schulte

[11] Patent Number: 5,570,515

[45] Date of Patent: Nov. 5, 1996

[54] HANDWEAR AND FOOTWEAR DRYING DEVICE

[76] Inventor: Dietmar Schulte, HR1-279 Brook Trail, Greenwood Lake, N.Y. 10925

[21] Appl. No.: 500,142

[22] Filed: Jul. 10, 1995

Related U.S. Application Data

[63] Continuation of Ser. No. 204,789, Mar. 2, 1994.

[51] Int. Cl.[6] ..... F26B 9/00

[52] U.S. Cl. ..... 34/104; 34/239

[58] Field of Search ..... 34/437, 439, 104, 34/105, 106, 107, 239

[56] References Cited

U.S. PATENT DOCUMENTS

| | | | |
|---|---|---|---|
| 3,513,564 | 5/1970 | Gramprie . | |
| 3,645,009 | 2/1972 | Ketchum . | |
| 3,793,744 | 2/1974 | Saita . | |
| 3,798,788 | 3/1974 | Kuntz . | |
| 4,136,464 | 1/1979 | Hay . | |
| 4,145,602 | 3/1979 | Lee | 34/104 |
| 4,171,580 | 10/1979 | Vabrinskas | 34/104 |
| 4,200,993 | 5/1980 | Blanc et al. | 34/104 |
| 4,265,030 | 5/1981 | Smallegan . | |
| 4,596,078 | 6/1986 | McCartney . | |
| 4,689,897 | 9/1987 | Marsalona . | |
| 4,727,656 | 3/1988 | Jannach . | |
| 4,768,293 | 9/1988 | Kaffka | 34/104 |
| 4,774,769 | 10/1988 | Dollst . | |
| 4,787,153 | 11/1988 | Chen | 34/104 |
| 4,967,060 | 10/1990 | Lomeli . | |
| 5,003,707 | 4/1991 | Chu | 34/104 |
| 5,058,289 | 10/1991 | Guindon | 34/104 |
| 5,155,925 | 10/1992 | Choi | 34/97 |
| 5,179,790 | 1/1993 | Poulos | 34/104 |
| 5,199,188 | 4/1993 | Franz . | |
| 5,222,308 | 6/1993 | Barker | 34/104 |
| 5,289,642 | 3/1994 | Sloan | 34/104 |

*Primary Examiner*—Henry A. Bennett
*Assistant Examiner*—Dinnatia Doster
*Attorney, Agent, or Firm*—David Everett Meeks

[57] ABSTRACT

A light weight, portable, and totally self contained unit for drying footwear, gloves and the like. A motor driven fan is energized by a battery pack by way of a switch to draw in air and through ports in a housing and to direct the air into a Y-divider and through two discharge tubes and into the item requiring drying.

14 Claims, 4 Drawing Sheets

HANDWEAR AND FOOTWEAR DRYING DEVICE

This is a continuation of application Ser. No. 08/204,789, filed Mar. 2, 1994.

BACKGROUND

1. Field of the Invention

This invention relates to drying handwear and footwear by blowing air into articles such as gloves and boots. The invention further relates to a compact, completely portable and self-contained drying device for use without the need of external power.

2. Description of Prior Art

At one time or another nearly everyone has their handwear or footwear moistened or wetted by the elements or perspiration. This results in the requirement for drying such articles for later use. It is commonly known that failure to dry these articles prior to reuse will result in unacceptable insulating properties of the garment and discomfort to the user.

Generally, users of handwear and footwear take their wet items indoors for drying, such as by a fireside or radiator. This results in the very slow drying of the article, resulting in some delay before the item can be reused outdoors.

Thereafter, inventors created several types of dryers or blowers for use in the home. One such device is disclosed in U.S. patent to Kaffka (1988). The device shown must be used in conjunction with home house current, and is therefore limited to home use. Thus, if an individual was in a remote area or outside of the availability of regular house current, the device was of no use whatsoever.

Other devices were invented for adaptation to hair dryers, as disclosed in U.S. Pat. Nos. 4,967,060 to Lomeli (1990) and 5,003,707 Chu (1991). Both of these devices require a separate hair dryer for their use, and are an accessory to hair dryers. These devices are limited in their use by the availability of a hair dryer and house current, and are not a complete apparatus for drying.

Other devices have been invented that use the air discharged from home heating systems, as disclosed in U.S. patents to Blanc et al. U.S. Pat. No. 4,200,993 (1980), Kuntz U.S. Pat. No. 3,798,788 (1974) and Jannach et al. U.S. Pat. No. 4,727,656 (1988). These devices rely on and work by channeling air or heated air from an external source into the article to be dried.

Other devices have been invented as disclosed in U.S. patents to Franz U.S. Pat. No. 5,199,188 (1993), Guindon U.S. Pat. No. 5,058,289 (1991), and Vabrinskas U.S. Pat. No. 4,171,580 (1979). These devices are designed for home use in that they require large amounts of electric power to achieve their desired objectives.

Other devices, such as U.S. patent to Dollst U.S. Pat. No. 4,774,769 (1988) rely on the use of an electric heater alone, without a fan or means for circulating air.

The device of the present invention allows for the efficient and economical drying of wet garments, especially shoes, boots, or gloves, in any remote location, such as on a camping trip in the woods, in a boat at sea, or any other place, with or without the availability of outside power sources. All of the devices heretofore know suffer from a number of disadvantages:

(a) The devices are heavy, complicated and not suitable for use outside of the home.

(b) The devices require such great amounts of electricity that their use is tied to the availability of home current or car batteries for their operation.

(c) The devices are merely an accessory to a home hair dryer, and can be used only where a hair dryer and house current are available.

(d) The devices require a forced air heating system in order to operate, and are not suitable outside of places where these systems are unavailable.

OBJECTS AND ADVANTAGES

Accordingly, several objects and advantages of the present invention are:

(a) to provide a garment drying device with an integral power source requiring no external connections;

(b) to provide a drying device with sufficient power and efficiency to dry garments overnight;

(c) to provide a garment drying device that can be repeatedly used for 25 or more times without depleting the power source;

(d) to provide an efficient and inexpensive ducting system for a garment drying device;

(e) to provide a drying device that is completely portable for outdoor use;

(f) to provide a drying device that is small in size and extremely rugged for use by outdoorsmen;

(g) to provide a garment drying device that adapts to a variety of sizes and shapes of gloves, boots, shoes and other items;

(h) to provide a drying unit which can be safely used by small children;

(i) to provide a drying unit that can be easily and conveniently used by young or old alike, the elderly or infirm and others; and (j) to provide a garment dryer that introduces significant economies in its manufacture.

Further objects and advantages are to provide a self-contained, portable unit that can be used by campers and other outdoorsmen, for multiple and repeated uses, and is light weight and rugged. Still further objects and advantages will become apparent from a consideration of the ensuing description and drawings.

DRAWING FIGURES

Figure 1:
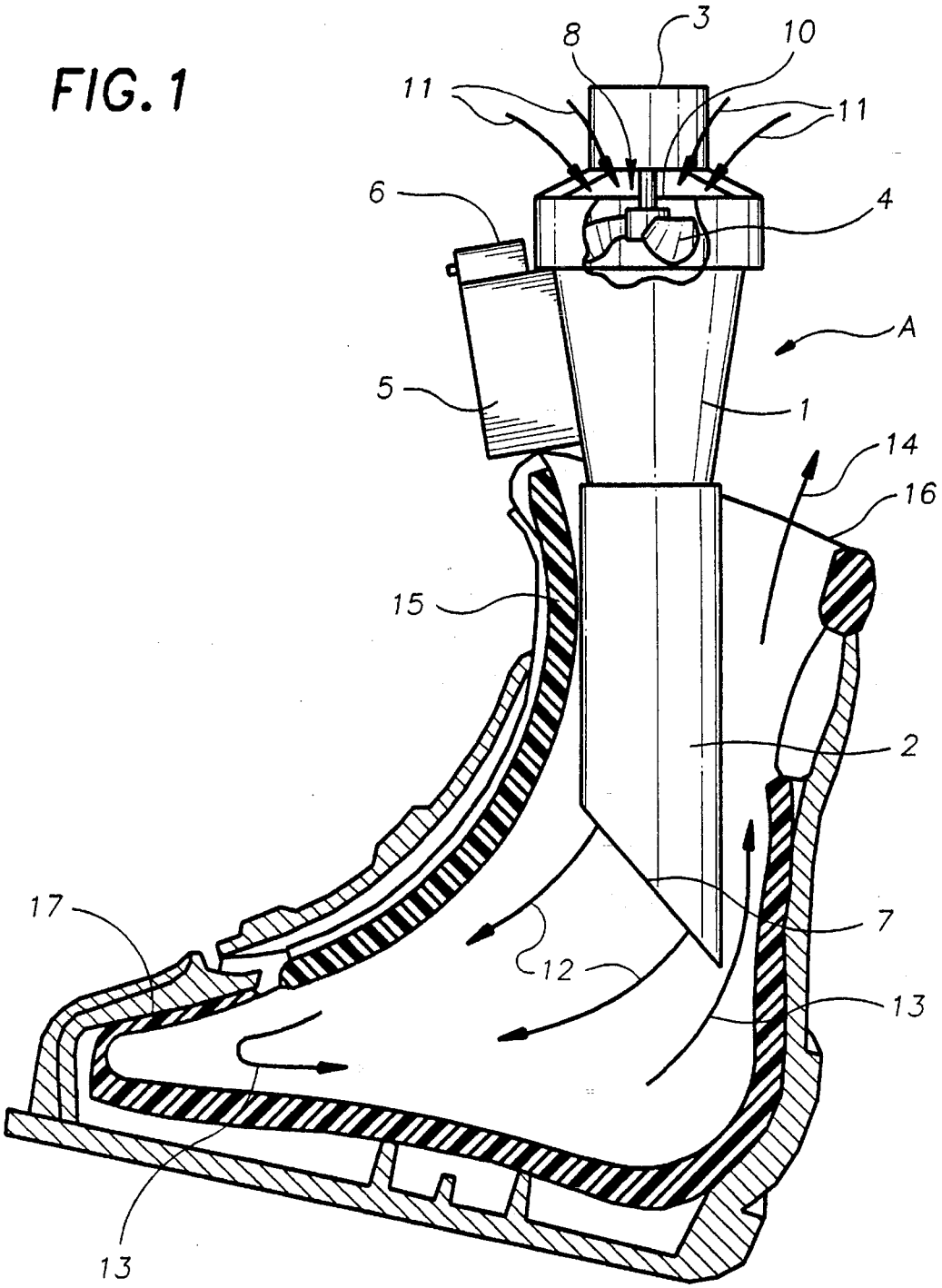
FIG. 1 is a section through a ski boot fitted with the drying device of this invention showing a portion of the device in section.

Reference Numerals in Drawings A Drying device

1 Discharge, tube, upper part

2 Discharge tube

3 Motor

4 Fan

5 Power source

6 Switch

7 Open end

8 Air intake port

9 V shape
10 Fan housing
11 Intake air
12 Drying air
13 Circulating air
14 Exhaust air
15 Ski boot
16 Open end
17 Toe end
3*a* motor housing
3*b* motor housing top plate
3*c* motor housing bottom plate
3*d*, 3*e* motor housing side plates
18 struts
19 bottom plate

DESCRIPTION—FIGS. 1–4

Figure 3:
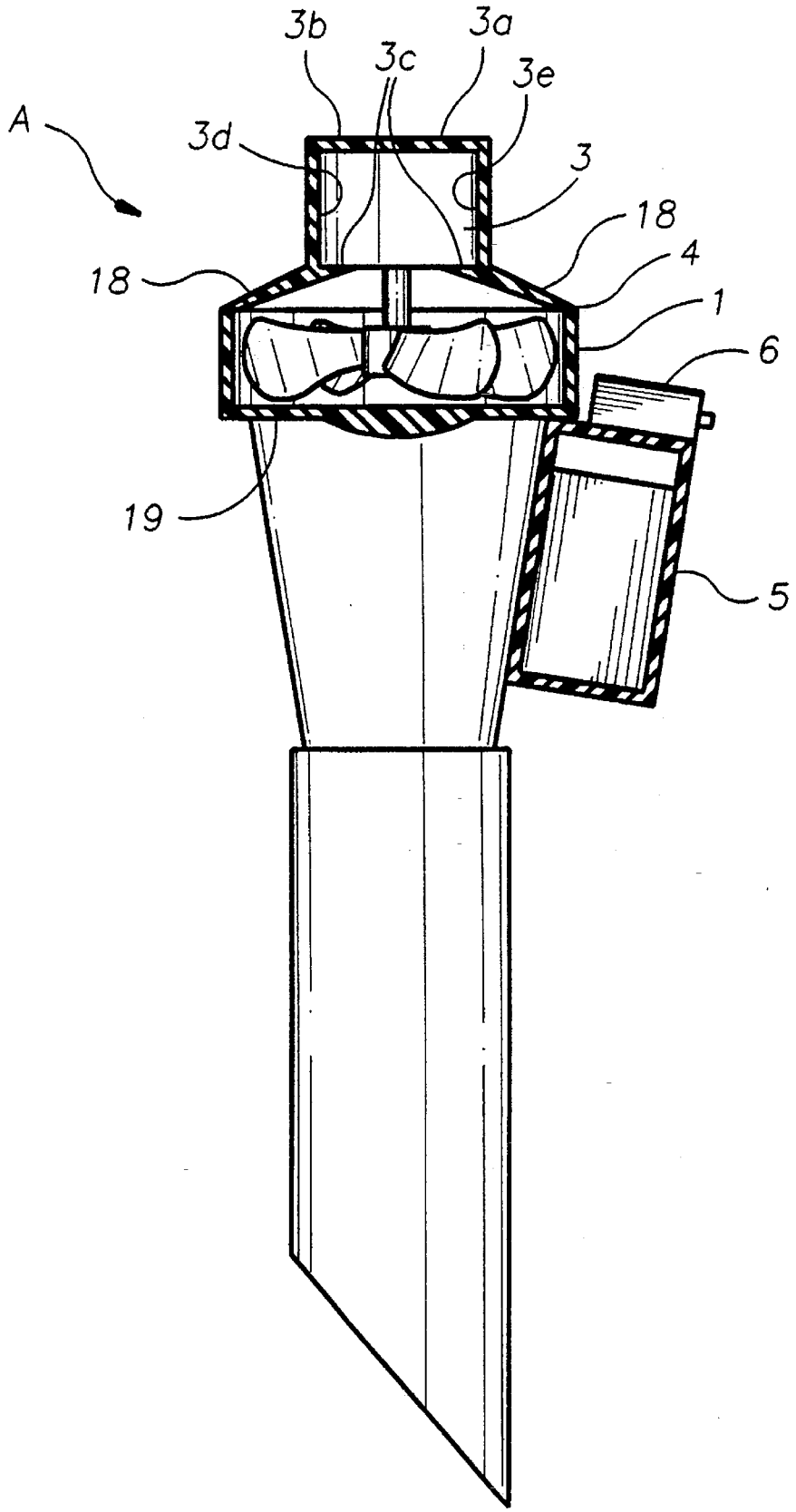
FIG. 3 is a simplified side elevation.

A typical embodiment of the present invention is illustrated in FIG. 1. The drawing shows a ski boot 15 having an interior and the drying device A of this invention placed within the hollow interior of the ski boot 15. The ski boot 15 has an open end 16 where the drying device is inserted into the ski boot 15. A discharge tube 2 having open ends is enclosed by the ski boot 15; the tube 2 directs the circulated air 12 from the device into the ski boot 15 through its open end 7. The open end 7 is cut on a diagonal to direct the drying air 12 towards the toe end 17 of the ski boot 15. Circulating air 13 then returns and becomes exhaust air 14 from the ski boot 15. The top of the device A has a motor 3, generally a lightweight DC motor, located in a motor housing 3*a* over a fan housing 10 and a fan 4 located within the fan housing 10. The motor housing has a top plate 3*b*, a bottom plate 3*c*, and two side plates 3*d*, 3*e*, as shown in FIG. 3. The upper part of the discharge tubes 1 diverts the drying air 12 to the lower part of discharge tubes 2 having open ends 7 cut on diagonals. A power source 5, shown as a box shaped receptacle, is attached to the side of the device along with an on off switch switch 6. The power pack 5 is a small housing containing batteries (not shown) and the necessary wiring and contacts (not shown) to connect to the switch 6 and motor 3. The motor housing 3*a* is connected to the fan housing by struts 18. The top of the fan housing 10 contains air intake ports 8, shown as the spaces between the struts 18, where air is drawn into the fan housing 10 by the action of the rotating fan 4.

Figure 2:
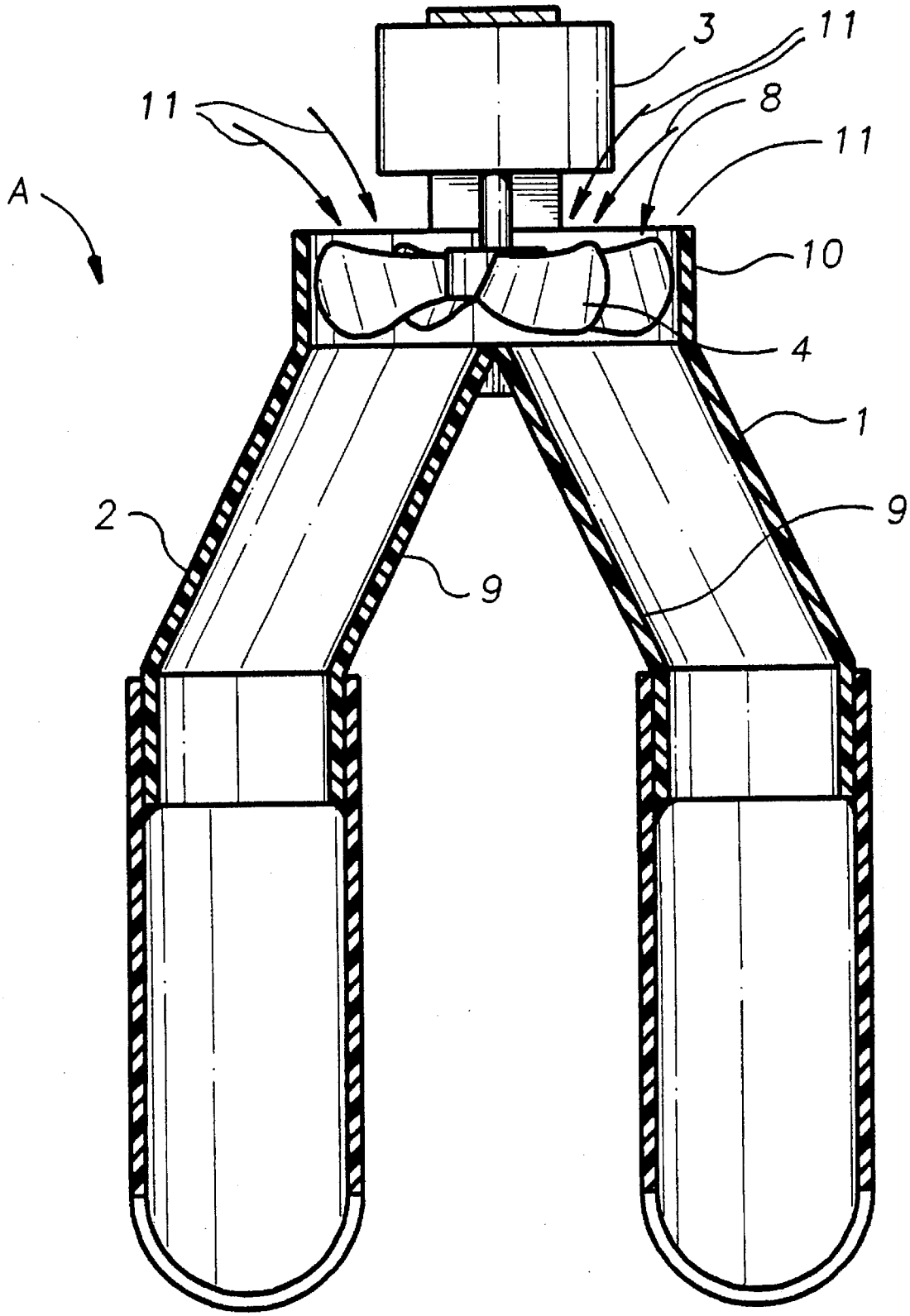
FIG. 2 is a simplified front elevation shown in section.

FIG. 2 and 3 show cross sections of the drying device. FIG. 2 shows a front view including upper part of discharge tubes 1 which is shaped into a V 9 that directs the drying air 12 in two directions; in one direction towards the first ski boot and in the second direction towards the second ski boot.

The fan housing 10 is located on top of the upper part of discharge tubes 1, and is generally cylindrical in shape to accommodate a fan 4. The upper part of the discharge tubes 1 are adapted to the fan housing 10 by a bottom plate 19. The bottom plate contains openings to allow the drying air 12 to pass from the fan housing 10 into the upper part of the discharge tubes 1, as shown in FIGS 2–3. The top side of the fan housing 10 has air intake ports 8, between struts 18, where intake air 11 is drawn into the device by the action of the fan 4 and motor 3. Intake air 11 is drawn into the fan housing 10 and then exhausted into the housing 1. The upper part of discharge tubes 1 is adapted to split the intake air 11 into two directions associated with each discharge tube 2. A power source 5 containing batteries is mounted on the upper part of discharge tubes 1 in the area of the V shape 9. A switch 6 is mounted on the power source 5.

Figure 4:
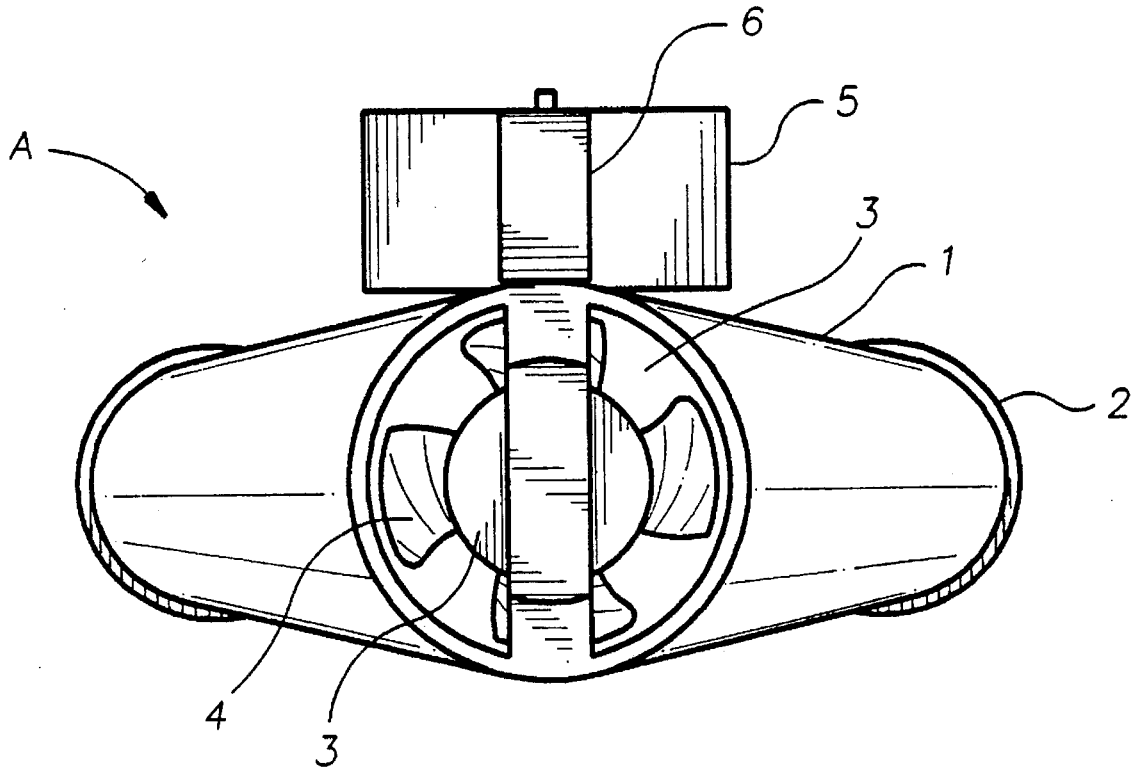
FIG. 4 is a simplified top elevation.

FIG. 4 shows a top view of the drying device including the air intake ports 8, the switch 6 and the power source 5. Also shown is the upper part of discharge tubes 1 and the lower part of the discharge tubes 2, the motor 3 and the fan 4.

From the description above, a number advantages of the drying device become evident:

(a) The device is efficient in design allowing for low cost manufacture from a minimum of materials.

(b) The device affords little obstruction to air flow, maximizing the duration of use from a small power source.

(c) The device is totally self-contained requiring no outside power source.

(d) The device is safe for even the smallest child because their is no exposure to high voltage or other dangerous parts.

OPERATION—FIGS. 1–4

At times, garments or other wearing apparel, including shoes, sneakers, boots, ice skates, gloves, and hats become wet from the wet weather, perspiration, or for some other reason, such as falling into a brook or lake. On many occasions, these garments must be quickly dried for further use. It is also common that these items must be dried before the wearer returns home or some other place where house current is readily available. For this reason, the operation of the invention described herein is based upon having a totally self contained unit that can be carried along on trips from the home, and is of such light weight design and high efficiency that the unit can be used numerous times on one charge of batteries. Additionally, extra sets of batteries can be packed to further increase the amount of drying time during the trip.

The device is used by first placing the lower part of discharge tubes 2 into the garment requiring drying. FIG. 1 shows an example of the device inserted into a ski boot 15. First one discharge tube 2 is placed into one boot, and then the other is placed into the second boot. The device can also be used by projecting both tubes 2 into an item such as a hat or other item requiring drying. After placement in the manner described above, the switch 6 is turned to the on position, allowing current to flow to the motor, and in turn rotating the fan 4 to blow air into the V shape 9 and discharge tubes 2. After the air leaves the discharge tubes 2 it circulates inside the garment, eventually discharging from an open part of the garment.

SUMMARY, RAMIFICATIONS, AND SCOPE

Accordingly, the reader will see that the drying device of this invention can be used by all persons, young or old, in circumstances where outside power sources are unavailable, such as on a camping trip or other outdoor adventure. It can also be carried on such trips because of its light weight design and efficient operation. It can also improve the safety of persons traveling far into the woods where the inability to dry shoes and gloves can result hypothermia of the wearer. Furthermore, the drying device of the present invention has the additional advantages in that (a) the plastic parts of the device can be easily molded and all the parts easily assembled for a low cost, light weight, efficient, portable device and (b) the device can be used by even the smallest child because it is safe in every respect and there is no threat of electrical shock.

Although the description above contains many specifications, these should not be construed as limiting the scope of the invention but as merely providing illustrations of some of the presently preferred embodiments of this invention.

Thus the above scope of the invention should be determined by the appended claims and their legal equivalents, rather than the examples given.

Claims: What is claimed is:

1. A drying device for blowing air into the interior of an item comprising:

(a) a fan housing having a substantially cylindrical shape and a center axis oriented vertically, said fan housing having a top and a bottom end and having a hollow interior, and said fan housing having a top portion and a top opening and a bottom portion and a bottom opening, and an outside surface;

(b) a motor housing, said motor housing mounted on the vertical axis over the top portion of said fan housing;

(c) two or more struts, each strut having a first end and a second end, said struts adapted to engage the motor housing by their respective first ends and the top portion of the fan housing by their respective second ends, whereby said motor housing is fixedly mounted by said struts to said top portion of said fan housing;

(d) spaces between said struts defining air inlet ports;

(e) a motor mounted within said motor housing;

(f) a fan disposed within said fan housing and oriented to rotate on said vertical axis, and sized to substantially span the distance across said hollow interior of said fan housing, thereby producing minimal clearances therebetween, wherein said motor is adapted to driveably engage said fan, whereby said motor drives said fan;

(g) a bottom plate that covers the bottom opening of said fan housing;

(h) one or more openings in said bottom plate;

(i) discharge tubes having open ends, each tube associated with a bottom plate opening, wherein one end of each discharge tube is adapted to engage said bottom plate over its respective bottom plate opening, wherein said tube opening communicates with said bottom plate opening and the hollow interior of said fan housing; and (j) a power source electrically connected to said motor and integral with said drying device;

whereby said fan draws air in through said spaces between said struts and directs the air into said discharge tubes and out the ends of said discharge tubes, wherein said combination together produces the required efficiencies to allow the user to carry the device along on excursions into the wilderness.

2. The device of claim 1, wherein said motor has a top surface and a bottom surface, wherein said motor housing comprises a top plate and a motor housing bottom plate and two side plates, said side plates are spaced from said vertical axis facing inwardly towards the vertical axis, said side plates adapted to conform to the shape of said motor and engage said motor, and said top plate connects the top ends of said side plates and is adapted to engage the top surface of said motor, and said motor housing bottom plate connects the bottom ends of said side plates and is adapted to engage the bottom surface of said motor, and wherein said device has two struts, the first end of one strut is attached to the motor housing where the bottom ends of one said side plate meets the motor housing bottom plate, and the first end of the second strut is attached to the motor housing on the opposite side of said motor housing where the bottom end of the opposite side plate meets the motor housing bottom plate.

3. The device of claim 1, wherein said discharge robes comprise two opposing discharge tubes, each tube having a first part and a second part, wherein said first part of each opposing tube diverges outwardly from said bottom plate forming an angle between in the shape of a V, and wherein said second part of each discharge tube extends downwardly and is substantially parallel with its opposing tube.

4. The device of claim 1, wherein said power source is a boxed shaped receptacle containing one or more batteries.

5. The device of claim 3, wherein said power source further includes a switch electrically connected between said batteries and said motor for starting and stopping said motor.

6. The device of claim 1, wherein said motor housing, struts, bottom plate, and discharge tubes are formed from hard plastic in one monolithic molded piece.

7. The device of claim 3, wherein said discharge tubes have a second end, wherein said second end is formed by a diagonal cut through said tube, whereby air is biased in a specific direction of flow upon exiting the tube.

8. The device of claim 1, where said motor is a lightweight DC motor.

9. A drying device comprising:

(a) a cylindrical fan housing having two opposed open ends and having a bottom plate over one open end;

(b) a motor housing mounted over the opposite open end of said fan housing;

(c) two struts extending from said fan housing to said motor housing, said struts, fan housing, and motor housing defining air inlet ports for entry of air into the fan housing;

(d) a motor mounted in said motor housing;

(e) a fan mounted in said fan housing, wherein said fan is sized to have minimal clearance between said fan housing, said motor rotatably connected to said fan for driving said fan;

(f) said bottom plate having two bottom plate openings;

(g) a discharge tube associated with each bottom plate opening, wherein said discharge tubes are adapted to engage said bottom plate over its respective opening, wherein said discharge tubes communicate with said bottom plate openings, said fan housing, and said air inlet ports; and (h) a power source in electrical cooperation with said motor comprising a receptacle containing one or more batteries therein and a switch, wherein said power source is integral with said drying device.

10. The device of claim 9, wherein said discharge tubes first extend outwardly and diverge, and then continue to extend parallel to each other.

11. The device of claim 9, wherein said fan housing, struts, motor housing, bottom plate, discharge tubes and receptacle together form a singular molded part.

12. A drying device comprising:

a fan housing having open ends, a motor housing mounted over one open end of said fan housing, struts connecting said motor housing to said fan housing, said struts having air spaces therebetween, said air spaces communicating with said fan housing forming air inlet ports, a fan mounted in and having minimal clearances with said fan housing, a motor mounted in said motor housing and adapted to rotate said fan, and discharge tubes extending from the open end of the fan housing opposite the end where the motor is mounted, said discharge tubes communicating with said fan housing, and a DC power pack mounted on the side of said discharge tubes and electrically connected to said motor.

13. The drying device as in claim 12, wherein said DC power pack includes a switch.

14. The drying device of claim 12, wherein said DC power pack is a box shaped receptacle containing batteries.

* * * * *